US005733397A

United States Patent [19]

McDaniel

[11] Patent Number: 5,733,397

[45] Date of Patent: Mar. 31, 1998

[54] BED SKIRT AND ASSOCIATED FABRICATING METHOD

[76] Inventor: Judy A. McDaniel, 122 Choctaw Cir., Harriman, Tenn. 37748

[21] Appl. No.: 831,617

[22] Filed: Apr. 9, 1997

[51] Int. Cl.[6] ..... A47G 9/04

[52] U.S. Cl. ..... 156/66; 5/493; 5/923; 29/91.1; 29/401.1

[58] Field of Search ..... 5/493, 482, 922, 5/923; 156/66; 29/91.1, 401.1

[56] References Cited

U.S. PATENT DOCUMENTS

| | | | |
|---|---|---|---|
| 4,141,097 | 2/1979 | Levinsohn et al. | 5/493 |
| 4,402,098 | 9/1983 | McClam | 5/494 |
| 4,682,379 | 7/1987 | Dugan | 5/500 |
| 4,985,953 | 1/1991 | Seago | 5/497 |
| 5,086,531 | 2/1992 | Carlos | 5/493 |
| 5,205,003 | 4/1993 | Green | 5/493 |
| 5,271,112 | 12/1993 | Bible et al. | 5/493 |
| 5,335,383 | 8/1994 | Schwind | 5/493 |
| 5,353,456 | 10/1994 | Evans | 5/493 |
| 5,540,480 | 7/1996 | Christa | 5/493 |
| 5,621,931 | 4/1997 | Hamilton | 5/493 |

*Primary Examiner*—Alexander Grosz
*Attorney, Agent, or Firm*—Pitts & Brittian, P.C.

[57] ABSTRACT

A bed skirt with removable skirt portion for being secured to the mattress foundation of a bed, and a fabricating method for fabricating such bed skirt. The bed skirt includes a skirt portion for being received around at least a portion of the perimeter of the mattress foundation. The bed skirt also includes a fastening mechanism for releasably securing the skirt portion to at least certain of the side walls of the mattress foundation such that the skirt portion extends around at least a portion of the perimeter of the mattress foundation. The fabricating method of the present invention includes the steps of disengaging the support panel from the skirt portion of the conventional bed skirt, and securing a first fastener component to an upper edge portion of the skirt portion. The method includes the further step of securing a second fastening component suitable for releasably engaging the first fastener component to the side walls of the mattress foundation, whereby the first fastener component can be releasably secure to the second fastening component to releasably secure the skirt portion about at least a portion of the perimeter of the mattress foundation.

5 Claims, 6 Drawing Sheets

Fig.3
(PRIOR ART)
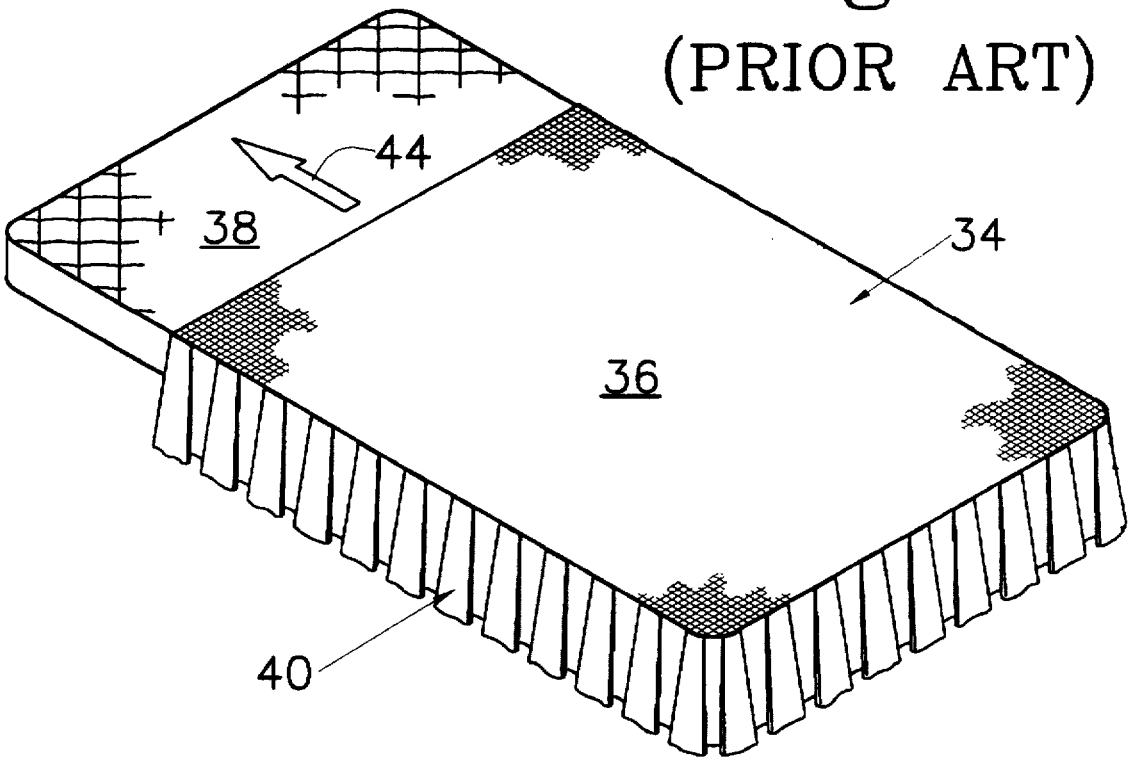
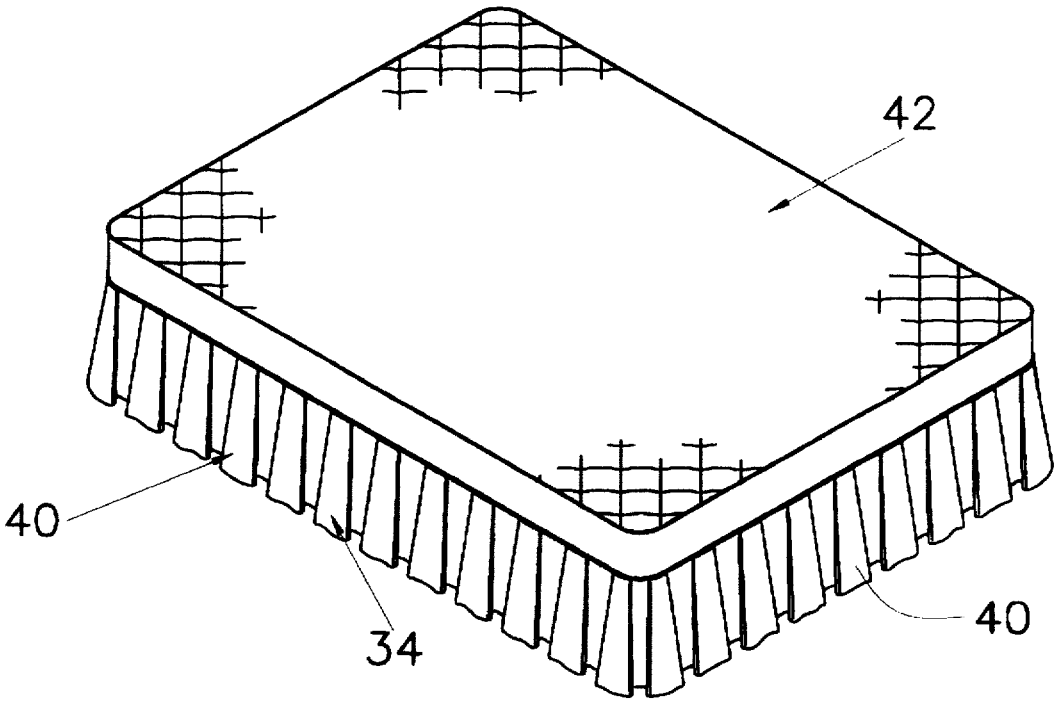
Fig.4
(PRIOR ART)

BED SKIRT AND ASSOCIATED FABRICATING METHOD

TECHNICAL FIELD

This invention relates a bed skirt for being secured to a mattress foundation and to a fabricating method for fabricating such bed skirt from a conventional bed skirt. In this particular invention the bed skirt includes a skirt portion and a mechanism for securing the skirt portion to a mattress foundation.

BACKGROUND ART

Beds skirts, or dust ruffles as they are sometimes called, are commonly used to limit air flow into the space beneath a bed so as to reduce the amount of dust which settles under the bed. Further, bed skirts are generally considered important decorative elements which can enhance the aesthetic qualities of the beds on which they are installed. A conventional bed skirt typically includes a support panel which is dimensioned to overlay the upper surface of the mattress foundation, such as a box spring, and which supports a skirt portion at its edges. The skirt portion extends around at least a substantial portion of the perimeter of the mattress foundation and extends downwardly such that the lower edge of the skirt portion terminates at or proximate the floor on which the associated bed is supported. As a consequence, the skirt portion forms an air flow barrier which limits air flow into the space beneath the bed. Further, a mattress overlays the support panel of the bed skirt such that the support panel is secured between the mattress foundation and the mattress, thereby securing the position of the skirt portion about the perimeter of the mattress foundation.

It will be recognized that the installation of a conventional bed skirt is easily accomplished if the mattress is removed from the mattress foundation. However, when the mattress is in place, installation requires pulling the support panel of the bed skirt between the mattress and foundation which is difficult due to the weight of the mattress. Likewise, removal of the conventional bed skirt can be difficult with the mattress in place given the weight of the mattress on the support panel. While removal of the mattress resolves the difficulty associated with installing or removing a conventional bed skirt, removal of the mattress is difficult and time consuming.

Attempts have been made to make bed skirts, and other bed clothing, easier to install and remove, but none of these efforts has resulted in a bed skirt which firmly holds the skirt portion of the bed skirt in place while also allowing for quick and easy installation and removal. Certain prior art bed clothing devices and systems are disclosed in U.S. Pat. Nos. 5,271,112; 4,985,953; 4,682,379; 4,402,098; and 4,141,097.

Therefore, it is an object of the present invention to provide an improved bed skirt with a removable skirt portion.

It is another object of the present invention to provide an improved bed skirt with a skirt portion which can be quickly and easily installed on, and removed from, a mattress foundation without removal of the mattress supported thereon.

Yet another object of the present invention is to provide an improved bed skirt which is inexpensive to manufacture.

Another object is to provide a mattress foundation to which an improved bed skirt can be releasably attached which is inexpensive to manufacture.

Still another object of the present invention is to provide a fabricating method for producing an improved bed skirt with an easily removable skirt portion out of a conventional bed skirt.

SUMMARY OF THE INVENTION

The present invention provides a bed skirt with removable skirt portion for being secured to the mattress foundation of a bed, such as a box spring. The bed skirt includes a skirt portion for being received around at least a portion of the perimeter of the mattress foundation, with the skirt portion defining an upper edge portion. The bed skirt also includes fastening mechanism for releasably securing the skirt portion to at least certain of the side walls of the mattress foundation such that the skirt portion extends around at least a portion of the perimeter of the mattress foundation. In one preferred embodiment such fastening mechanism defines a hook and loop fastening mechanism including at least one first fastener component secured along the upper edge portion of the skirt portion, and at least one second fastener component secured to the side walls of the mattress foundation so as to extend around at least a portion of the perimeter of the mattress foundation. The invention also includes a method for fabricating a bed skirt with a removable skirt portion from a conventional bed skirt having a support panel defining edges secured to a skirt portion. The method includes the steps of disengaging the support panel from the skirt portion of the conventional bed skirt, and securing a first fastener component to the upper edge portion of the skirt portion. The method includes the further step of securing a second fastening component suitable for releasably engaging the first fastener component to the side walls of the mattress foundation, whereby the first fastener component can be releasably secure to the second fastening component to releasably secure the skirt portion about at least a portion of the perimeter of the mattress foundation.

BRIEF DESCRIPTION OF THE DRAWINGS

The above mentioned features of the invention will be more clearly understood from the following detailed description of the invention read together with the drawings in which:

FIG. 3 illustrates a perspective view of a prior art bed skirt being installed on a mattress foundation.

FIG. 4 illustrates a perspective view of a prior art bed skirt as installed on a mattress foundation.

BEST MODE FOR CARRYING OUT THE INVENTION

A removable bed skirt incorporating various features of the present invention is illustrated generally at 10 in the Figures. The bed skirt 10 is designed to be releasably secured about the sides of a mattress foundation, such as a box spring, to prohibit dust from traveling under a bed, and for enhancing the appearance of the bed. In this regard, beds commonly comprise a box spring which supports a mattress thereon. However, it is not uncommon for a bed to comprise a pair of stacked mattress with a lower mattress serving as the foundation for an upper mattress. Therefore, for purposes of this application the term "mattress foundation" is intended to include a box spring, mattress, or other foundation structure which serves to support the mattress of a bed.

Figure 1:
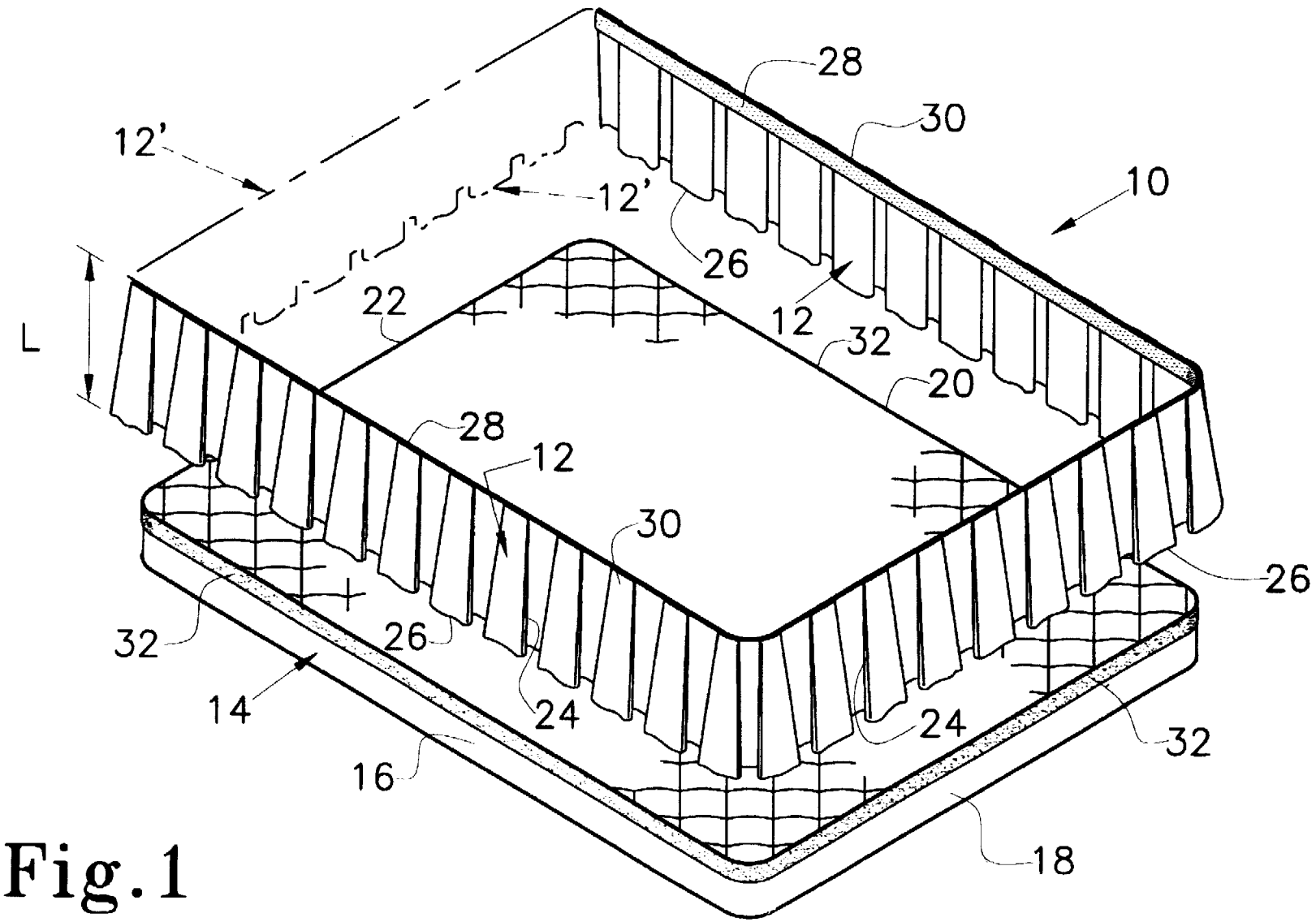
FIG. 1 illustrates a perspective view of a bed skirt of the present invention.
Figure 2:
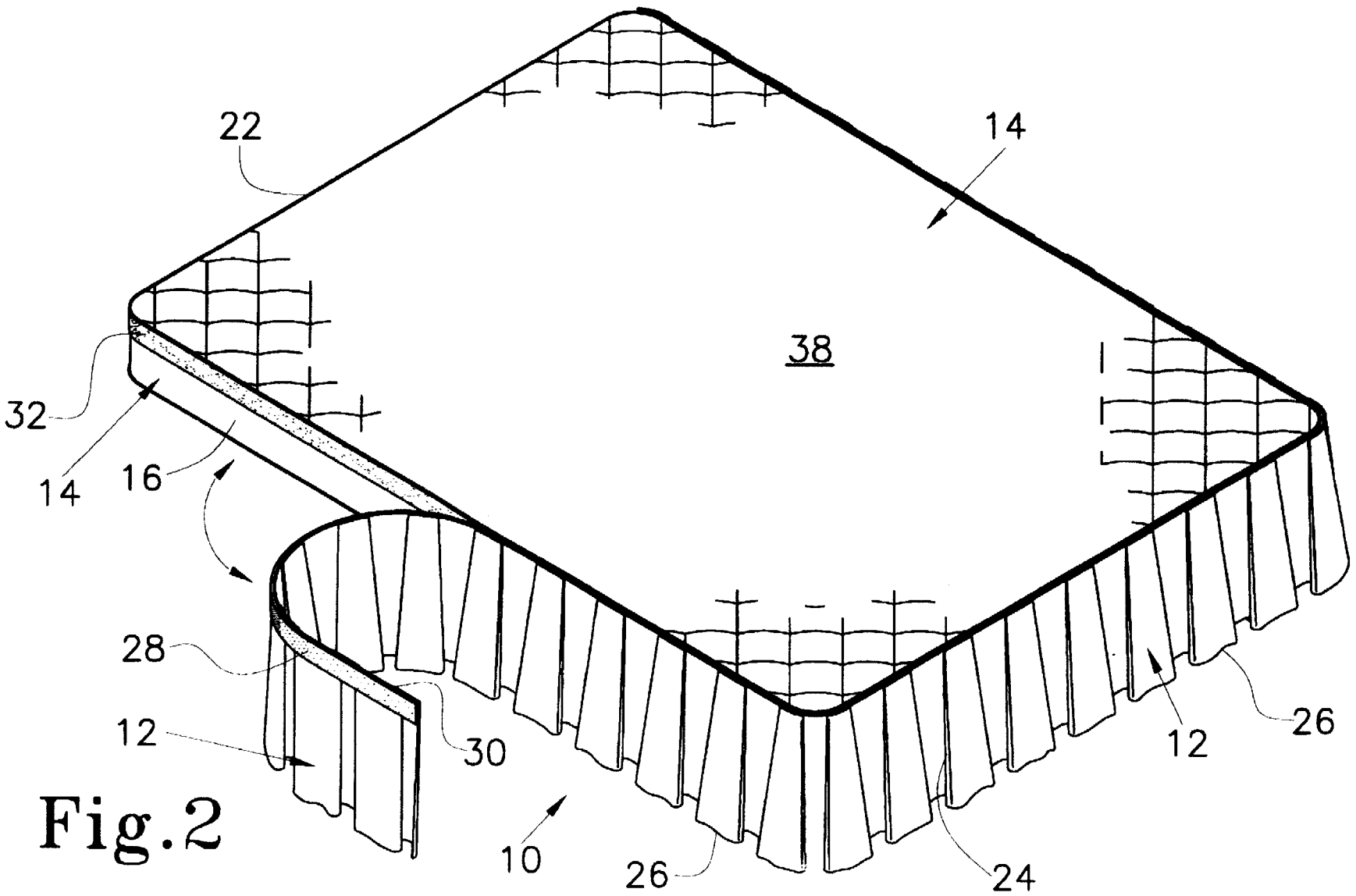
FIG. 2 illustrates a perspective view of a bed skirt of the present invention.

As illustrated in FIGS. 1 and 2, in the preferred embodiment the bed skirt 10 includes a skirt portion 12 for extending around at least a portion of the perimeter of a mattress foundation, such as the illustrated mattress foundation 14. In this regard, the mattress foundation 14 defines a rectangular configuration having first, second, third and forth side portions 16, 18, 20 and 22, respectively. Generally, a bed skirt is received only around the side portions 16, 18, and 20 of the foundation 14 with it being contemplated that a head board (not shown) will be positioned proximate the side portion 22, or contemplating that the side portion 22 will be positioned proximate a wall, thereby obviating the need for a bed skirt which extends along the side portion 22. However, in certain circumstances it may be desirable to extend the skirt portion 12 along the side portion 22 such that the skirt portion 12 extends around the entire perimeter of the mattress foundation 14 as indicated by the phantom lines at $12^1$ in FIG. 1.

The skirt portion 12 is preferably fabricated of a cloth or fabric material, but various flexible materials could be used. Further, the illustrated skirt portion 12 defines selectively spaced pleats 24. It will be understood that the pleats 24 are decorative in nature and may be omitted, or other decorative pleat configurations can be used if desired. The length L of the skirt portion 12 may selectively vary depending upon the bed to which it is affixed. However, the length L is preferably selected such that the lower edge 26 of the skirt portion is positioned at or proximate the floor on which the associated bed is supported such that the skirt portion serves as an effective barrier to dust laden air.

The bed skirt 10 is also provided with a mechanism for releasably securing the skirt portion 12 to the mattress foundation 14. In the preferred embodiment the mechanism for releasably securing the skirt portion 12 to the mattress foundation 14 includes at least one hook and loop fastener. More specifically, the hook and loop fastener includes a first fastener component 28 which is secured along the upper portion 30 of the skirt portion 12. The hook and loop fastener also includes a second fastener component 32 secured to the upper portions of at least the side portions 16, 18, and 20 of the mattress foundation for releasably engaging the first fastener component 28. Further, as discussed above, the second fastener component 32 can also extend along the upper portion 30 of the side portion 22 if the bed skirt 10 is to extend around the entire perimeter of the foundation 14. Accordingly, as illustrated in FIG. 2, the skirt portion 14 can be releasably secure to the mattress foundation 14 by bringing the first fastener component 28 into contact with the second fastener component 32, thereby releasably securing the upper portion 30 of the skirt portion 12 to the side portions of the mattress foundation 14.

Figure 7:
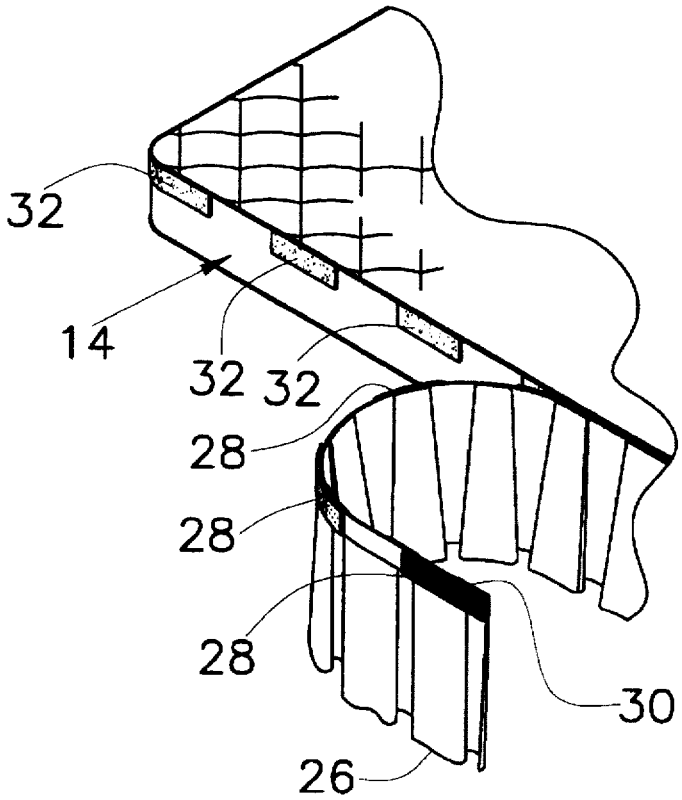
FIG. 7 illustrates a partial perspective view of an alternate embodiment of the bed skirt of the present invention.

It will be noted that in the preferred embodiment the first fastener component 28 defines the hook component of the hook and loop fastener, and the second fastener component 32 defines the loop component of the hook and loop fastener. However, it will be understood that the first fastener component 28 can define the loop component and the second fastener component 32 can define the hook component, if desired. It will also be understood that the bed skirt 10 can be provided with a plurality of selectively spaced first and second fastener components 28 and 32, respectively, as illustrated in FIG. 7, rather than the continuously extending components 28 and 32 illustrated in FIGS. 1 and 2.

The advantages of the present invention can be readily seen by comparing the bed skirt 10 with the typical prior art bed skirt illustrated at 34 in FIGS. 3 and 4. The prior art bed skirt 34 includes a support panel 36 which is dimensioned to overlay the upper surface 38 of the mattress foundation 14, and which supports a skirt portion 40 at its edges. As illustrated in FIG. 4, the mattress 42 of the bed overlays the support panel 36 thereby securing the support panel 36 between the mattress foundation 14 and the mattress 42 and securing the position of the skirt portion 40 about the perimeter of the mattress foundation 14. Thus, installation of the prior art bed skirt 34 is easily accomplished if the mattress 42 is removed from the foundation 14. However, when the mattress 42 is in place, installation requires pulling the support panel 36 between the mattress 42 and foundation 14 (for example, in the direction of the arrow 44 in FIG. 3) which is difficult due to the weight of the mattress 42 and can cause tearing or stretch damage to the skirt material. Indeed, for some people installation with the mattress in place may be impossible. Likewise, removal of the prior art bed skirt 34 can be difficult with the mattress 42 in place given the weight of the mattress 42 on the support panel 36.

Figure 5:
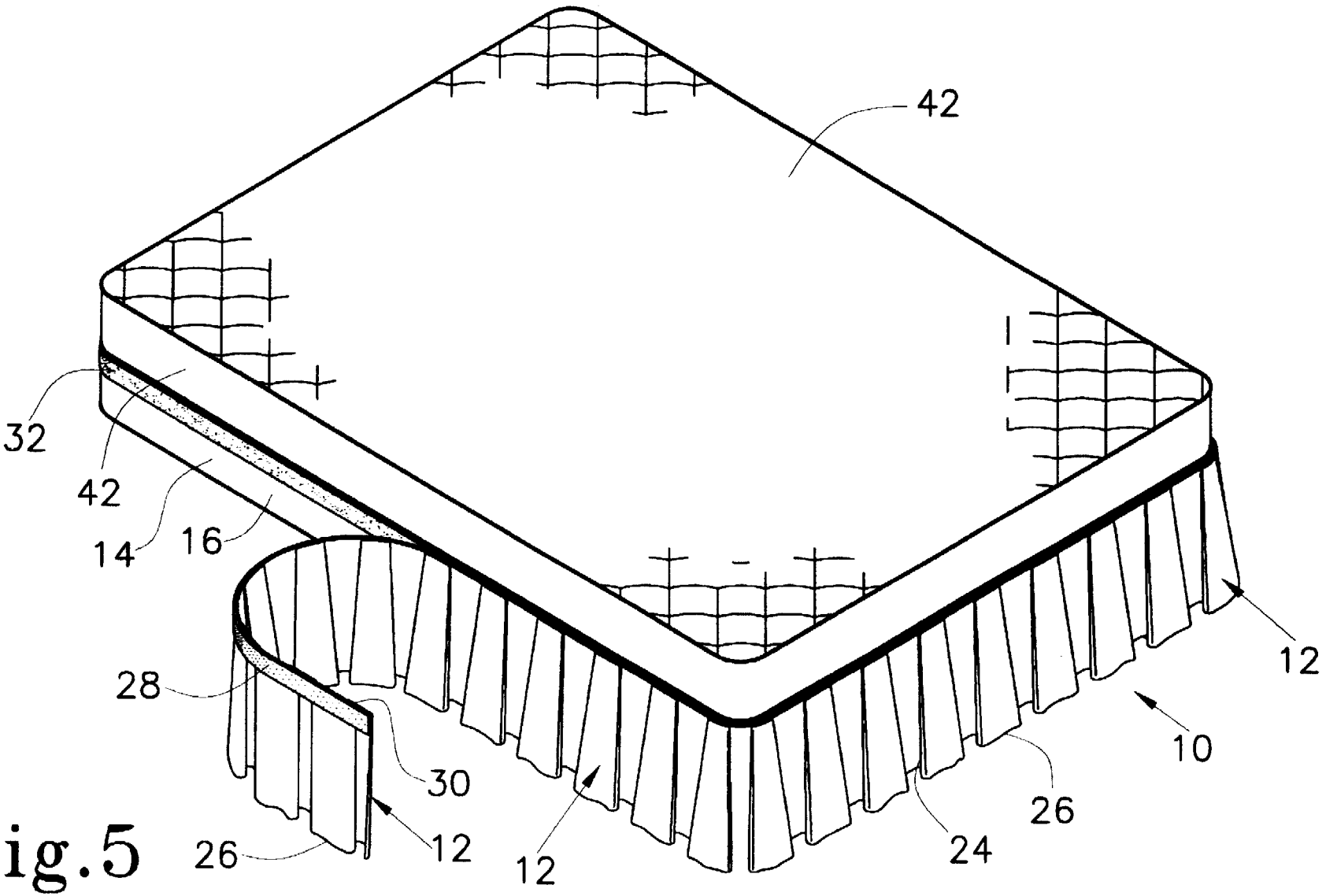
FIG. 5 illustrates a perspective view of a bed skirt of the present invention being installed on a mattress foundation while a mattress is being supported by the mattress foundation.

By comparison, and as illustrated in FIG. 5, the skirt portion 12 of the bed skirt 10 can be easily installed, or removed, with the mattress 42 in place by simply engaging, or disengaging, the hook and loop fastener components 28 and 32. Thus, whereas the difficulty of installing and removing prior art bed skirts often discourages people from purchasing bed skirts or comforters, or leads to a user delaying the cleaning or replacement of a bed skirt, the bed skirt 10 can be easily removed and reinstalled for cleaning, or replacement. Indeed, given the ease with which the bed skirt 10 can be removed and installed, multiple skirt portions 12 defining different colors and/or styles can be interchangeably used to facilitate a frequent change in room decor.

Figure 6A:
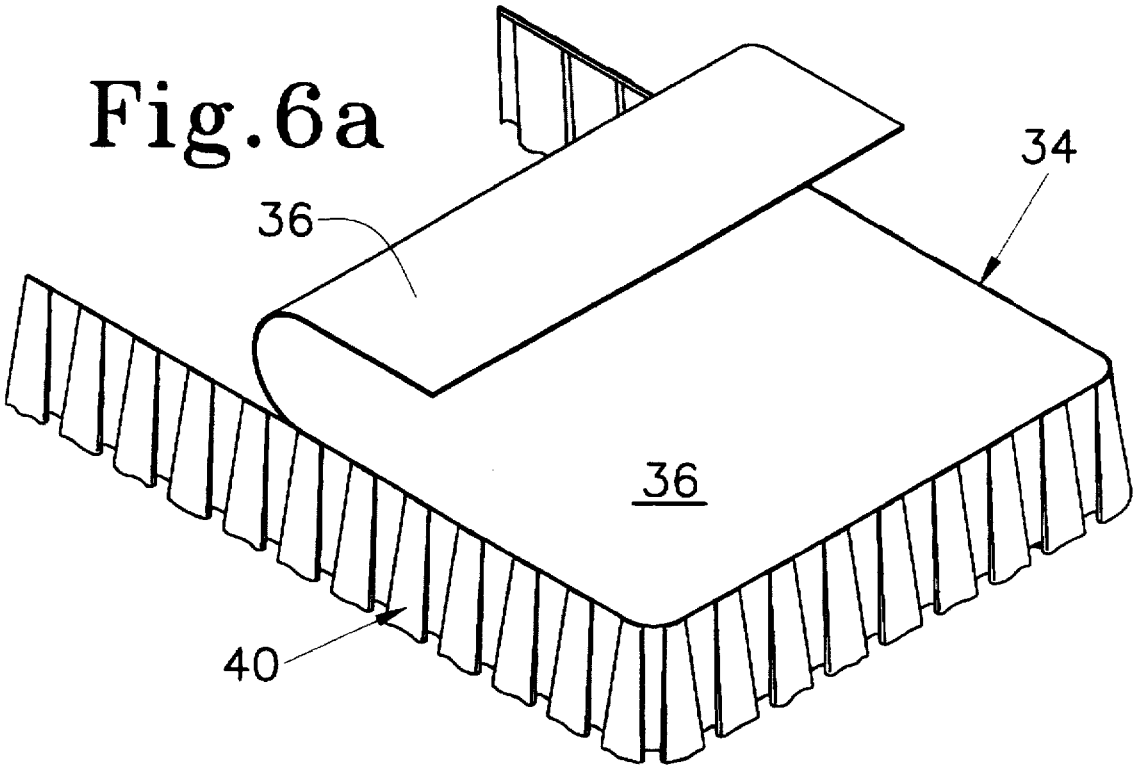
FIG. 6A illustrates a perspective view of a prior art bed skirt wherein the support panel is being removed in accordance with the fabricating method of the present invention.
Figure 6B:
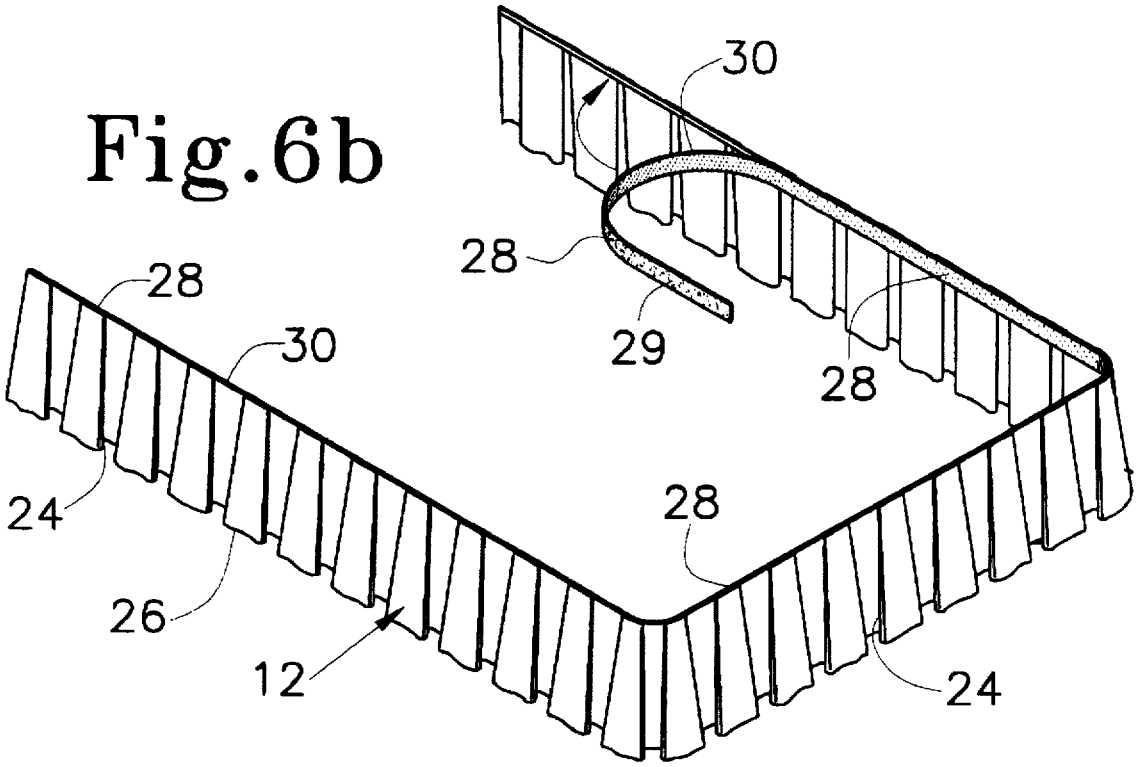
FIG. 6B illustrates a perspective view of the skirt portion of a prior art bed skirt wherein a first fastener component is being secured to the skirt portion in accordance with the fabricating method of the present invention.
Figure 6C:
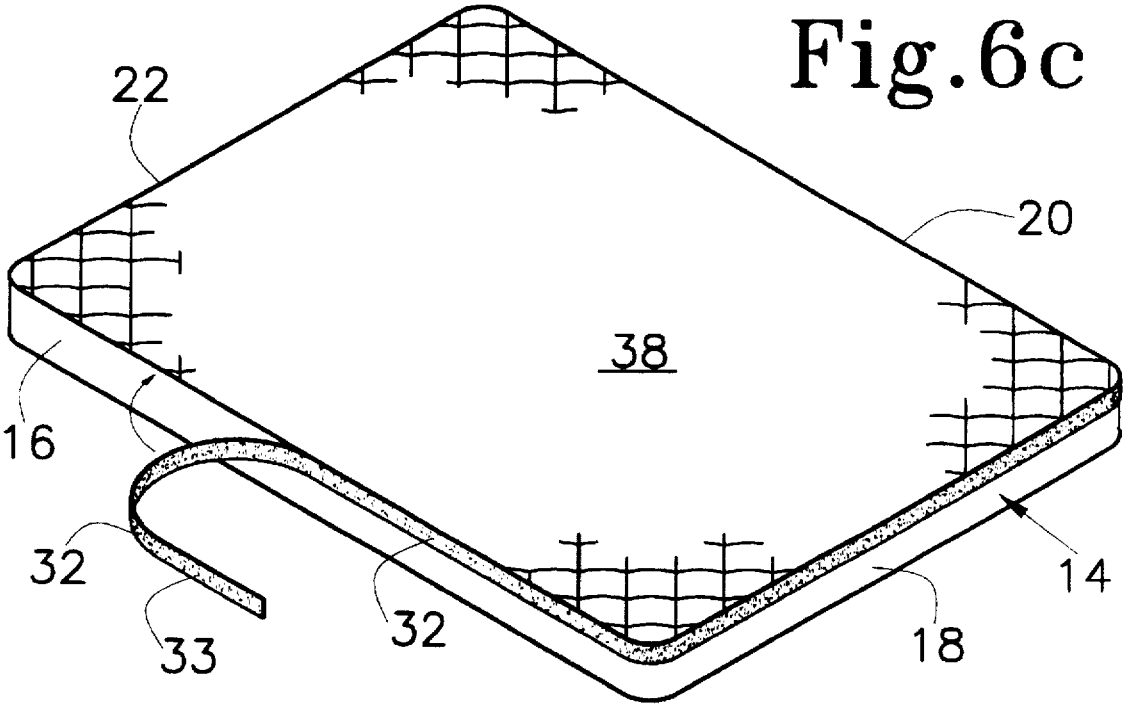
FIG. 6C illustrates a perspective view of a conventional mattress foundation wherein a second fastener component is being secured to the mattress foundation in accordance with the fabricating method of the present invention.

Further, it is contemplated that a prior art bed skirt, such as the bed skirt 34 can be used to fabricate a bed skirt 10. In accordance with the fabricating method of the present invention, and as illustrated in FIG. 6A, the support panel 36 is removed or cut away to produce a skirt portion 12, and, as illustrated in FIG. 6B, a first fastener component 28 is secured to the upper portion 30 of the skirt portion 12. This can be accomplished either by securing the first fastener component 28 to the skirt portion 12 with an adhesive, or by sewing or other suitable fastening means. In the preferred application of the fabricating method an adhesive is provided on the rear surface 29 of the first fastener component 28 to facilitate securing the component 28 to the skirt portion 12. Also, as illustrated in FIG. 6C, a second fastener component 32 is secured around the side portions of the mattress foundation 14. This is preferable accomplished by securing the second fastener component 32 to the mattress foundation 14 with an adhesive provided on the rear surface 33 of the component 32, but it will be recognized that the second fastener component 32 can be secured to the foundation 14 by sewing or other suitable fastening means. With the first and second fastener components 28 and 32, respectively, in place, the skirt portion 12 can be releasably installed about the foundation 14 as described above. Thus, the fabricating method of the present invention allows persons to purchase conventional bed skirts which may have the aesthetic qualities which they desire, and convert them into bed skirts 10) such that they can be more easily installed and removed.

In light of the above it will be recognized that the present invention provides a bed skirt and an associated fabricating method having great advantages over the prior art. The bed skirt 10 can be quickly and easily installed or removed, and such installation can be accomplished while the mattress remains in place on the mattress foundation 14. Moreover, the fabricating method of the present invention allows a prior art bed skirt to be converted into a bed skirt 10. However, while a preferred embodiment has been shown and described, it will be understood that there is no intent to limit the invention to such disclosure, but rather it is intended to cover all modifications and alternate constructions and/or methods falling within the spirit and scope of the invention as defined in the appended claims.

I claim:

1. A method for fabricating a bed skirt with removable skirt portion for being received about a mattress foundation having a perimeter defined by a plurality of side walls, said method utilizing a conventional bed skirt having a support panel defining edges secured to a skirt portion, said method comprising the steps of:

disengaging the support panel from the skirt portion of the conventional bed skirt;

securing a first fastener component to an upper edge portion of the skirt portion; and securing a second fastening component suitable for releasably engaging the first fastener component to the side walls of the mattress foundation, whereby the first fastener component can be releasably secure to the second fastening component to releasably secure the skirt portion about at least a portion of the perimeter of the mattress foundation.

2. The method of claim 1 wherein said first fastener component defines a hook component of a hook and loop fastener, and the second fastener component defines a loop component of the hook and loop fastener.

3. The method of claim 2 wherein said step of securing a first fastener component to an upper edge portion of the skirt portion includes securing a rear surface of said first fastener component to the upper edge portion of the skirt portion with an adhesive.

4. The method of claim 2 wherein said step of securing a second fastening component suitable for releasably engaging the first fastener component to the side walls of the mattress foundation includes securing a rear surface of said second fastener component to the side walls of the mattress foundation with an adhesive.

5. The method of claim 3 wherein said step of securing a second fastening component suitable for releasably engaging the first fastener component to the side walls of the mattress foundation includes securing a rear surface of said second fastener component to the side walls of the mattress foundation with an adhesive.

* * * * *